US005955032A

United States Patent [19]

Kelly et al.

[11] Patent Number: 5,955,032

[45] Date of Patent: Sep. 21, 1999

[54] COLLECTION CONTAINER ASSEMBLY

[75] Inventors: Karin E. Kelly, Los Angeles, Calif.; Joel L. Williams, Cary; Larry A. Monahan, Raleigh, both of N.C.

[73] Assignee: Becton Dickinson and Company, Franklin Lakes, N.J.

[21] Appl. No.: 08/928,273

[22] Filed: Sep. 12, 1997

[51] Int. Cl.[6] ..... B01L 3/14

[52] U.S. Cl. ..... 422/100; 422/102; 600/579

[58] Field of Search ..... 422/102, 99, 100, 422/101; 128/763; 600/576, 579, 583

[56] References Cited

U.S. PATENT DOCUMENTS

| | | | |
|---|---|---|---|
| 3,814,079 | 6/1974 | Le Roy, Sr. | 422/102 X |
| 4,012,325 | 3/1977 | Columbus . | |
| 4,416,291 | 11/1983 | Kaufman . | |
| 4,483,616 | 11/1984 | Liston et al. | 356/246 |
| 4,578,588 | 3/1986 | Galkin | 250/432 |
| 4,956,298 | 9/1990 | Diekmann | 430/311 |
| 4,980,129 | 12/1990 | Columbus | 422/61 |
| 5,096,062 | 3/1992 | Burkardt et al. | 206/361 |
| 5,156,811 | 10/1992 | White | 422/100 |
| 5,167,929 | 12/1992 | Korf et al. | 422/102 |
| 5,236,604 | 8/1993 | Fiehler | 210/782 |
| 5,364,595 | 11/1994 | Smith | 422/100 |
| 5,454,958 | 10/1995 | Fiehler | 210/782 |
| 5,456,887 | 10/1995 | Calvo et al. | 422/104 |
| 5,458,113 | 10/1995 | Burns | 128/763 |
| 5,496,523 | 3/1996 | Gazit et al. | 422/100 |
| 5,527,513 | 6/1996 | Burns | 422/102 |
| 5,536,476 | 7/1996 | Baxter | 422/102 |

*Primary Examiner*—Jeffrey Snay

*Attorney, Agent, or Firm*—Nanette S. Thomas; Keith McWha

[57] ABSTRACT

The present invention is a collection container assembly comprising a container having a microporous partition so as to reduce the internal volume of the container wherein the external dimensions of the container are substantially the same as a standard-sized blood collection tube but with a reduced internal volume.

16 Claims, 4 Drawing Sheets

COLLECTION CONTAINER ASSEMBLY

BACKGROUND OF THE INVENTION

1. Field of the Invention

This invention relates to a specimen collection container assembly and more particularly to a collection container for collecting biological fluid specimens where a small quantity of fluid may be collected and retained in the container while maintaining a container size sufficient to be easily accommodated and/or compatible with standard clinical equipment and instrumentation.

2. Description of Related Art

Blood samples and other biological fluid specimens are routinely taken and analyzed in hospital and clinical situations for various medical purposes. Collection, handling and testing of these samples typically requires the use of various medical testing instruments. As the blood and fluid specimens are usually collected in a standard sized collection tube, the medical instruments used to test the samples are designed to accommodate these standard sized collection tubes.

Conventional blood collection tubes used in most clinical situations are elongated cylindrical containers having one end closed by a semi-spherical or rounded portion and an opposed open end. The open end may be sealed by a resilient cap or stopper. The tube defines a collection interior which collects and holds the blood sample. The most common size of these blood collection tubes are designed to accommodate approximately 10 ml of blood or other biological fluid samples. Illustrative of such blood collection tubes is the VACUTAINER® brand blood collection tube sold by Becton, Dickinson and Company, 1 Becton Drive, Franklin Lakes, N.J. (registered trademark of Becton, Dickinson and Company).

A phlebotomist or other medical technician typically obtains a specimen of the patient's blood in the tube by techniques well known in the art. The tube is then appropriately labeled and transferred from the site of collection to a laboratory or other location where the contents of the tube are analyzed. During collection and analysis the tube may be supported by various medical instruments. The plasma or serum derived therefrom is processed and analyzed either manually, semiautomatically or automatically. In some cases, the specimen must first be dispensed from the collection tube to a sample test tube or cuvette.

In certain situations it is only necessary to obtain a small quantity of blood or other biological fluid specimens. These situations may include pediatric, or geriatric patients and other instances where large blood samples are not required. Small quantities of blood cannot be easily collected in standard collection tubes as described above because the sample level in such containers would not be adequate for retrieval prior to analysis. Such small quantities of fluids also have a tendency to significantly evaporate when stored in larger containers, thus concentrating the chemical and enzymatic constituents therein. This may result in erroneous analytical results and could possibly affect the diagnosis and treatment given to the patient. Therefore, it is desirable to employ small-volume containers which substantially inhibit evaporation for the storage and delivery of minute fluid samples in the laboratory.

Various specimen containers such as those incorporating a "false bottom" have been proposed to achieve decreased volume capacity in conjunction with standard external dimensions. However, these various specimen containers are not compatible with standard clinical equipment and instrumentation due to their design. In particular, these specimen containers have false bottoms with a generally flat, planar bottom end and a circular shaped opening.

Other specimen containers include partial-draw tubes which have standard external dimensions with partial evacuation so that blood fills only a portion of the internal volume. However, partial-draw tubes exhibit a reduction in the draw rate of a sample which reduces the collection efficiency of such tubes. In addition, partial-draw tubes may result in an inconsistent fill volume which may alter test results. Furthermore, it is difficult to determine accurate sample quantities with such partial-draw tubes because the slow rate of sample draw is not consistently measurable.

In clinical use, it is desirable for such specimen collection containers to have rounded bottom configurations that closely simulate a standard-sized blood collection tube configuration instead of planar bottoms. Rounded bottom configurations facilitate compatibility with clinical equipment and instrumentation.

Therefore there is a need to provide a specimen collection container assembly for collecting blood samples and other biological fluid specimens of relatively small volumes where the assembly may be accommodated and/or compatible with standard clinical equipment and/or instrumentation and where the integrity of the sample and specimens are maintained during draw, storage and transport.

SUMMARY OF THE INVENTION

The present invention is a collection assembly comprising a container. The container preferably comprises an open top portion, a bottom portion and a sidewall extending from the open top portion to the bottom portion. The bottom portion comprises a closed bottom end. The assembly further comprises a microporous partition permanently positioned within the interior of the container and most preferably near the closed bottom end. Optionally, the assembly may further comprise a closure at the open top portion of the container.

Most preferably, the microporous partition occupies space within the container so as to reduce the interior volume of the container thereby creating a false bottom to the container. Most preferably, the microporous partition is non-removable within the container.

The microporous partition of the container provides a false bottom effect to the assembly and the microporous partition also provides a means for allowing the container to be modified so as to be compatible with standard clinical equipment and instrumentation.

The microporous partition comprises a support ring with a microporous material. The support ring comprises a top portion, a bottom portion, and a annular skirt extending from the rim of the top portion to a stop end at the bottom portion. The microporous material is preferably attached to the rim of top portion of the support ring. Most preferably, the microporous material is attached to the rim of the top portion of the support ring by heat seal or adhesive.

The microporous partition may be made from microporous polypropylene, microporous polyethylene, and microporous teflon.

The support ring may be made from a biologically inert material such as a polyester.

The microporous partition may be may be integral with the container or may be a discrete member. Additionally, the top portion of the support ring may be arcuate in shape and the microporous material fitted to the arcuate shape to provide a volume for the container whereby the top portion of the microporous partition would provide a partially rounded internal bottom portion to the container.

In addition, the assembly may further comprise a closure such as a cap or a stopper at the open end of the container.

Most preferably, the assembly of the present invention can be either evacuated or non-evacuated. Notably, both sides of the microporous partition can be evacuated. However, when a liquid specimen is drawn into the container, the liquid will only fill to the partition level since the liquid will not penetrate the microporous material.

Desirably, the assembly is made from polyethylene terephthalate, polypropylene, polyethylene, polyethylene napthalate polyvinyl chloride or copolymers thereof.

An advantage of the assembly of the present invention is that it provides a full-draw blood collection container assembly having a reduced internal volume but with external dimensions about the same as a standard-sized blood collection s container assembly. In addition, the assembly of the present invention has a standard draw rate as compared to partial draw rate tubes.

A standard-sized blood collection container has an outer diameter of about 13 to about 16 millimeters, a length of about 75 to about 100 millimeters and an internal volume of about 6 to about 10 milliliters.

A further advantage of the assembly of the present invention is that it provides a specimen collection container which is universally compatible with various clinical equipment and instrumentation.

The assembly of the present invention may be easily handled by equipment configured to handle standard-sized blood collection tubes having standard external dimensions.

Most notably, is that the assembly of the present invention provides a blood collection container having full draw external dimensions but with a reduced internal volume as compared to standard-sized full draw blood collection tubes or standard-sized partial draw blood collection tubes.

The assembly of the present invention therefore addresses the need for a full-draw low-volume blood collection container assembly that presents the external dimensions of a standard-sized blood collection tube.

The assembly of the present invention may be used to reliably collect small samples of blood or biological fluids and to maintain the integrity of the samples during storage and transport as compared to using standard-sized blood collection tubes. In addition, the assembly of the present invention can also be accommodated by standard-sized blood collection, transportation, storage, and diagnostic equipment. Furthermore, the assembly of the present invention may be used to reliably collect small samples of blood or biological fluids without being under partial pressure.

Most notably, is that the assembly of the present invention provides a rounded bottom configuration that is substantially the same as a standard-sized blood collection tube with a fully rounded bottom. This particular feature in conjunction with all of the features of the container, distinguishes it from the specimen containers that have flat planar bottoms and from partial draw blood collection tubes.

The assembly of the present invention is also compatible with existing instrumentation, labels, and bar code readers and obviates the need for new instrumentation and handling devices or procedures that would be required for smaller or varying sized tubes or tubes with flat planar bottoms.

DETAILED DESCRIPTION

The present invention may be embodied in other specific forms and is not limited to any specific embodiment described in detail which is merely exemplary. Various other modifications will be apparent to and readily made by those skilled in the art without departing from the scope and spirit of the invention. The scope of the invention will be measured by the appended claims and their equivalents.

Figure 1:
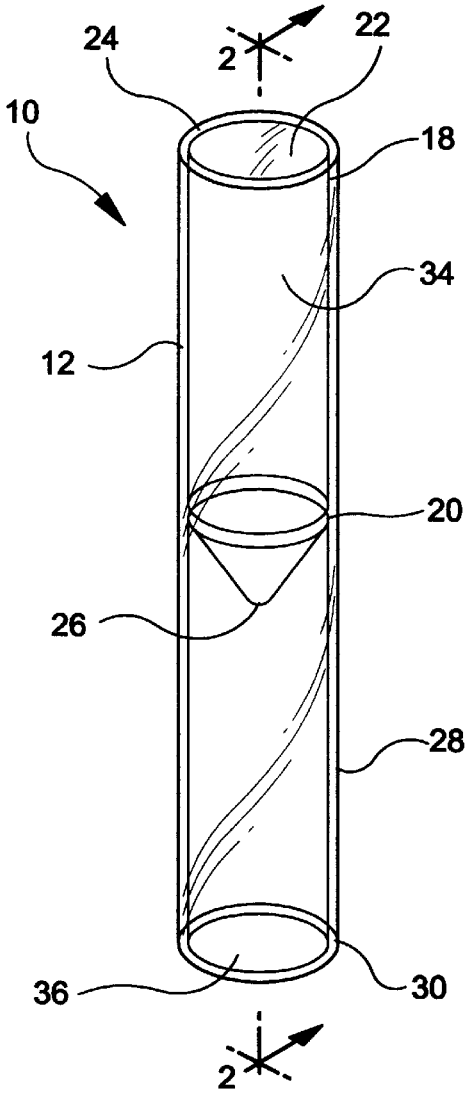
FIG-1 PRIOR ART
FIG. 1 is a perspective view of a false bottom specimen tube of the prior art.
Figure 2:
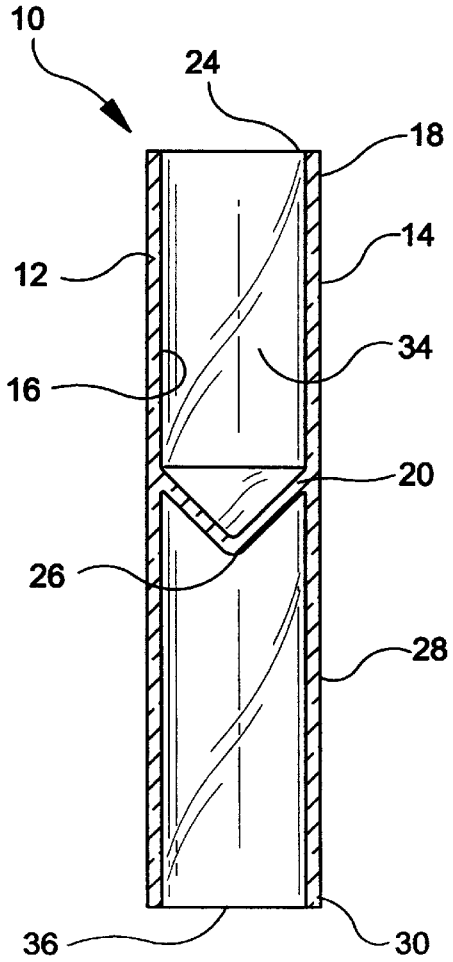
FIG-2 PRIOR ART
FIG. 2 is a longitudinal sectional view of the tube of FIG. 1 taken along line 2—2 thereof.

Referring to the drawings in which like reference characters refer to like parts throughout the several views thereof, FIGS. 1 and 2 show a false bottom specimen container 10 of the prior art, having a sidewall 12 having an outer surface 14 and an inner surface 16. Sidewall 12 extends from an upper portion 18 to a lower portion 20. Upper portion 18 includes an open end 22 and a rim 24. Lower portion 20 comprises a closed bottom end 26. An annular skirt 28 extends from lower portion 20 and outer surface 14 to a flat planar bottom end 30 to define an open false bottom area 36. Interior volume 34 extends between rim 24 and closed bottom end 26.

Figure 3:
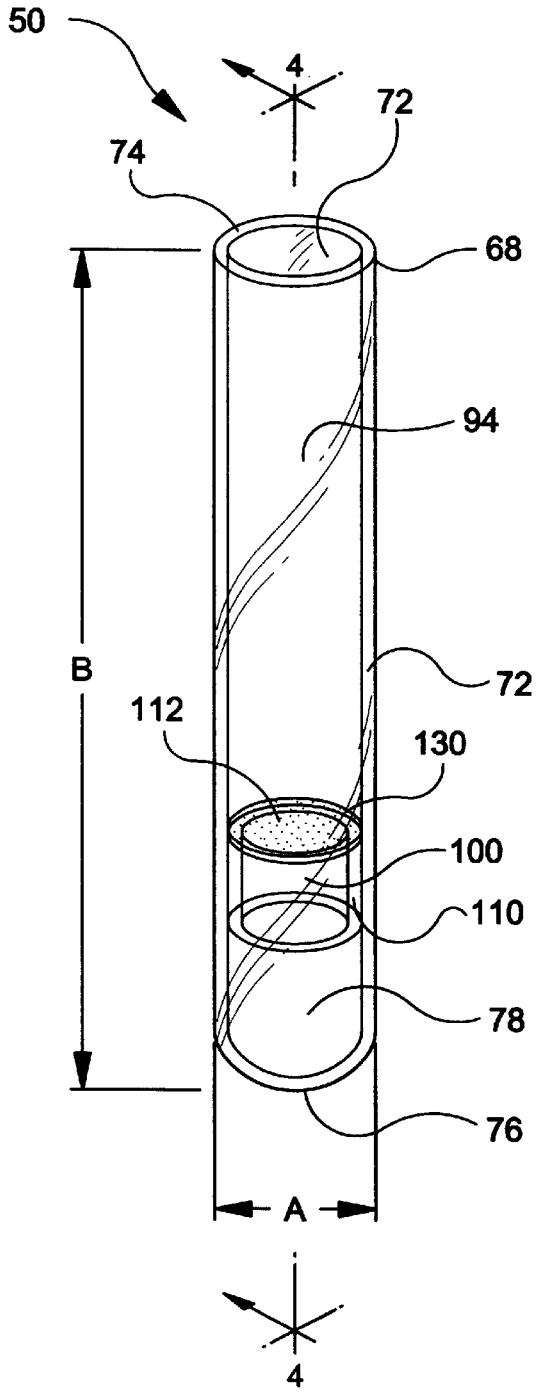
FIG. 3 is a perspective view of the assembly of the present invention with the microporous partition.
Figure 4:
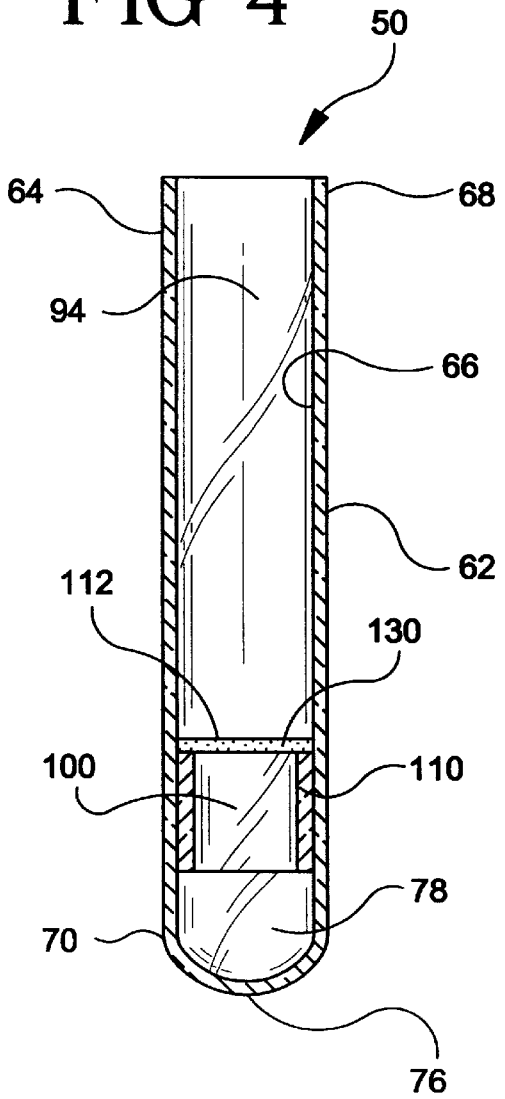
FIG. 4 is a longitudinal sectional view of the assembly of FIG. 3 taken along line 4—4 thereof.

Referring to the drawings in which like reference characters refer to like parts throughout the several views thereof, FIGS. 3 and 4 show the preferred embodiment of the present invention, assembly 50. Assembly 50 is false bottom a specimen container, having a sidewall 62 having an outer surface 64 and an inner surface 66. Sidewall 62 extends from an upper portion 68 to a lower portion 70. Upper portion 68 includes an open end 72 and a rim 74. Lower portion 70 comprises a closed bottom end 76 with closed bottom interior area 78. In addition, a microporous partition 100 is located near or in closed bottom interior area 78.

Figure 5:
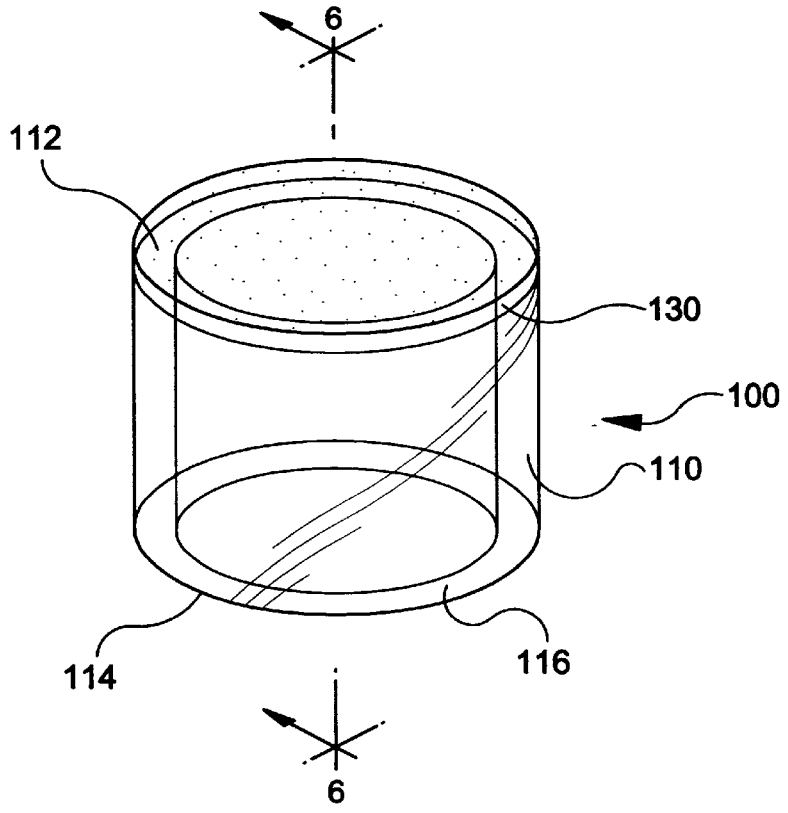
FIG. 5 is a perspective view of the microporous partition.
Figure 6:
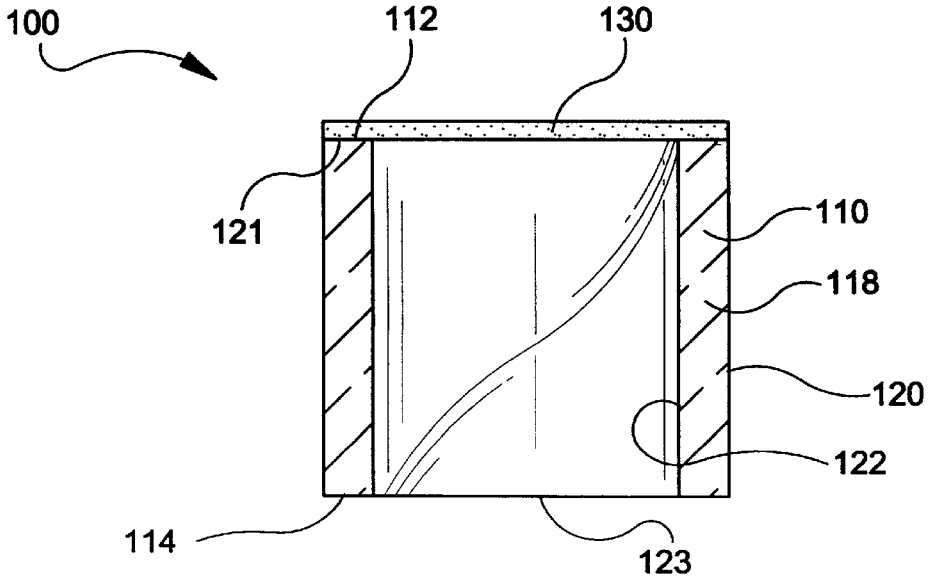
FIG. 6 is a longitudinal sectional view of the microporous partition of FIG. 5 taken along 6—6 thereof.

As shown in FIGS. 5 and 6, microporous partition 100 includes a support ring 110 and a microporous material 130. Support ring 110 comprises a top portion 112, a bottom portion 114 and an annular skirt 116 extending from the top portion to the bottom portion. Annular skirt 116 comprises a sidewall 118 having an outer wall surface 120 and an inner wall surface 122. Top portion 112 is shown as having a top surface 120 that is a substantially flat or planar surface, however it is within purview of this invention that top surface 120 with top portion 112 may be any shape such as conical, concave, convex, arcuate, or semi-spherical. Bottom portion 114 is shown having a stop end surface 123 that is a substantially flat or planar surface, however it is within purview of this invention that stop end surface 123 with bottom portion 114 may be any shape such as substantially flat, planar, conical, concave, convex or arcuate or semi-spherical. Microporous material 130 is attached to top surface 120 by an adhesive or heat seal.

Support ring 110 is most preferably made of a biologically inert material such as a polyester, that will not have any effect on fluids collected in the container. Microporous petition 100 is most preferably fixed with the closed bottom interior area of the container so that it will not travel when the container is subjected to stress or process handling situations such as transport and centrifugation.

Additionally, microporous petition 100 may be integral with sidewall 62 or may be a discrete member. Preferably microporous partition 100 is integrally formed with sidewall 62.

Microporous partition 100 may be adhesively fixed to the inner surface of the sidewall of the container or microporous partition 100 may be formed wherein annular skirt 116 has a larger diameter than the inner diameter of the container so that the microporous partition may be held in place by an interference fit, whereby an interference fit exists between the outer wall surface of the support ring and the inner sidewall of the container whereby there is sufficient resistance of the microporous partition from moving within the container when the container is subjected to stress or process handling situations, such as transport and centrifugation.

In addition to providing a false bottom to a container as well as a reduced volume to a container, microporous partition 100 may also serve as a visual indicator for things such as tube type, draw volume or shelf life. The visual indicator may be that the plug is a certain color or color pattern.

Microporous partition 100 may be positioned at any point below rim 74 thus providing a variable interior volume 94 between rim 74 and top portion 112 of the microporous partition. Most preferably, top portion 112 of the microporous partition may be arcuate in shape to provide at least a partially rounded false bottom surface for interior volume 94.

Microporous partition 100 provides means for converting the assembly to substantially the same external dimensions as a standard-sized blood collection tube.

As shown in FIG. 3, assembly 50 has an outer diameter A of about 16 millimeters, a length B of about 75 millimeters, as measured from rim 74 to closed bottom end 76 and an interior volume 94 of about 1 to 3 milliliters, as measured from rim 74 to top portion 112 of microporous partition 100. It is within the purview of this invention that assembly 50 may have an outer diameter of about 13 to about 16 millimeters, a length of about 75 to about 100 millimeters and interior volume of about 1 to about 3 milliliters.

Figure 7:
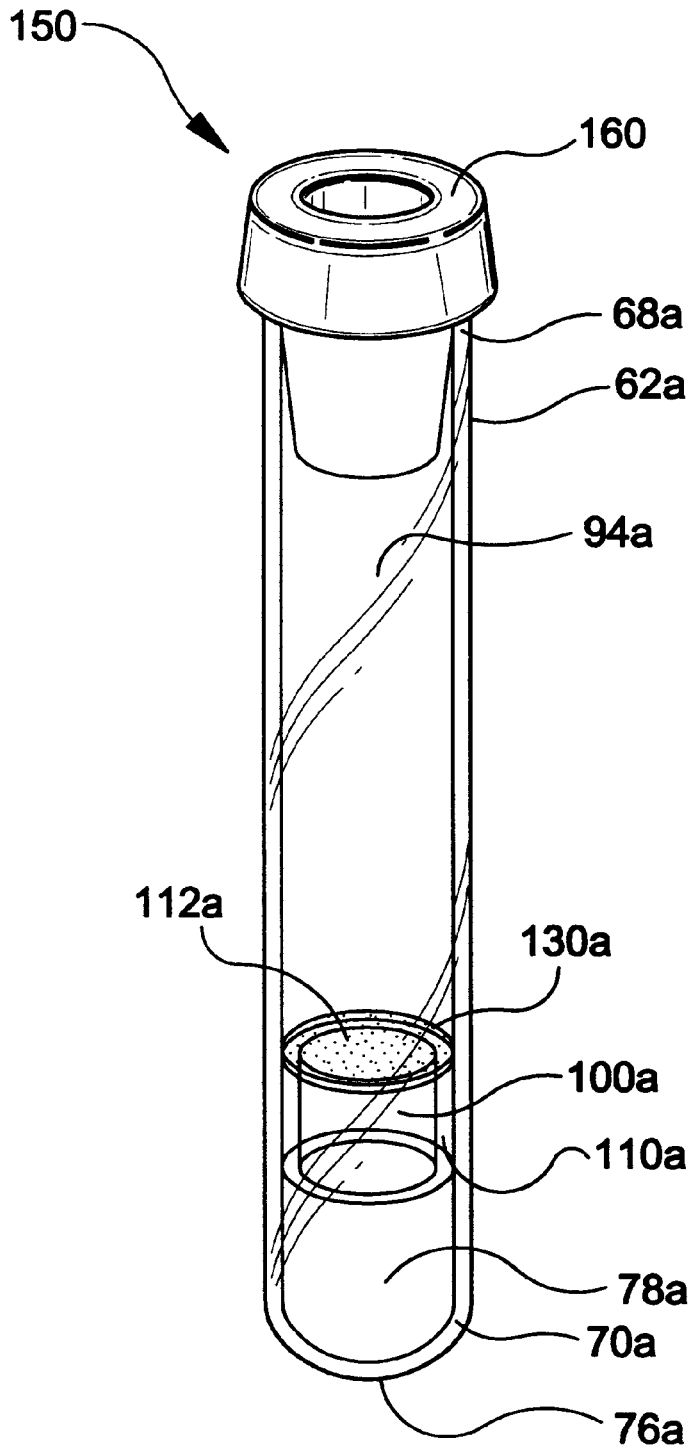
FIG. 7 is a perspective view of an alternate embodiment of the present invention.

The invention, as shown in FIG. 7 includes many components which are substantially identical to the components of FIGS. 3–4. Accordingly, similar components performing similar functions will be numbered identically to those components of FIGS. 3–4, except that a suffix "a" will be used to identify the similar components in FIGS. 7.

As illustrated in FIG. 7, a further embodiment of the invention is assembly 150 which includes a closure 160.

The embodiment of FIG. 7 may be evacuated or non-evacuated. When assembly 150 is evacuated, interior volume 94*a* is typically maintained at a lower-than-atmospheric internal pressure so that when a blood collection probe penetrates through the closure placing interior volume 94*a* in communication with the circulatory system of a patient, the lower-than-atmospheric pressure of interior volume 94*a* will draw blood from the patient into the tube. Assembly 150 may be described as a full-draw blood collection tube because the internal pressure of interior volume 94*a* is low enough to draw a volume of blood substantially equal to the volume of interior volume 94*a*.

What is claimed is:

1. A collection assembly for collecting a liquid specimen comprising:

a container comprising a top portion, a bottom portion, a side wall extending from said top portion to said bottom portion, and said container having internal volume; and a microporous partition comprising a support ring with a microporous material wherein said support ring comprises an arcuate top portion, a bottom portion, an annular skirt extending between said top portion and said bottom portion and said microporous material is attached to said top portion, and said microporous material preventing penetration of the liquid specimen and allowing air to penetrate such that the collection assembly provides for reduced internal volume of said container and a fully evacuated volume of said container.

2. The assembly of claim 1, wherein said bottom portion of said container is a closed bottom end.

3. The assembly of claim 1, wherein said bottom portion of said container is arcuate in shape.

4. The assembly of claim 1, wherein said microporous partition is permanently fixed at the bottom portion of said container.

5. The assembly of claim 1, further comprising a closure.

6. The assembly of claim 1, wherein said container is made from polyethylene terephthalate, polypropylene, polyethylene, polyethylene napthalate, polyvinyl chloride, or copolymers thereof.

7. The assembly of claim 1, wherein assembly comprises an outer diameter, a length and an internal volume, wherein said outer diameter is about 13 to about 16 millimeters, said length is about 70 to about 100 millimeters, and said interior volume is about 1 to 3 millimeters.

8. The assembly of claim 1, wherein said microporous partition is a visual indicator.

9. The assembly of claim 1, wherein said microporous partition is joined to said container by an adhesive.

10. The assembly of claim 1, wherein said microporous material is attached to said top portion of said support ring by an adhesive.

11. The assembly of claim 1, wherein said microporous material is attached to said top portion of said support ring by heat seal.

12. The assembly of claim 1, wherein said microporous partition maintains an interference fit with said container.

13. The assemnly of claim 1, wherein said microporous material is made of a bioligically inert material.

14. The assembly of claim 13, wherein said biologically inert material is a polyester.

15. The assembly of claim 1, wherein said microporous partition is made from polyethylene terephthalate, polypropylene, polyethylene, polyethylene napthalate, polyvinyl chloride, or copolymers thereof.

16. The assembly of claim 15, wherein said microporous partition is a color or color pattern.

* * * * *